US007285146B2

(12) United States Patent
Petersen

(10) Patent No.: US 7,285,146 B2
(45) Date of Patent: Oct. 23, 2007

(54) RESILIENT ABRASIVE ARTICLE

(75) Inventor: John G. Petersen, Center City, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/275,361

(22) Filed: Dec. 28, 2005

(65) Prior Publication Data

US 2007/0144074 A1 Jun. 28, 2007

(51) Int. Cl.
*B24D 3/00* (2006.01)
*B24D 11/00* (2006.01)

(52) U.S. Cl. ..... 51/307; 51/308; 51/309; 51/295; 51/298; 451/533; 451/536; 451/539

(58) Field of Classification Search ..... 51/307–309, 51/298, 295; 451/533, 536, 539
See application file for complete search history.

(56) References Cited

U.S. PATENT DOCUMENTS

| | | | | |
|---|---|---|---|---|
| 5,158,557 | A | 10/1992 | Noreen et al. | |
| 5,707,903 | A | 1/1998 | Schottenfeld | |
| 6,613,113 | B2 | 9/2003 | Minick et al. | |
| 6,638,601 | B1 * | 10/2003 | Follensbee | 428/143 |
| 6,641,463 | B1 * | 11/2003 | Molnar | 451/41 |

* cited by examiner

*Primary Examiner*—Michael Marcheschi
(74) *Attorney, Agent, or Firm*—David B. Patchett

(57) ABSTRACT

A resilient hand-held abrasive article includes a flexible conformable backing layer having opposed first and second major surfaces, a flexible reinforcing layer affixed to at least one of the backing layer first and second major surfaces, and abrasive particles arranged on the reinforcing layer, thereby defining an abrasive surface. The backing layer comprises a multiplicity of separated resilient bodies connected to each other in a generally planar array in a pattern that provides open spaces between adjacent connected bodies.

15 Claims, 1 Drawing Sheet

RESILIENT ABRASIVE ARTICLE

BACKGROUND

The present invention relates generally to abrasive articles for abrading a work surface and, more particularly, to resilient abrasive articles.

Sheet-like abrasive articles are commonly used in a variety of sanding operations including hand sanding of wooden surfaces. In hand sanding, the user holds the abrasive article directly in his or her hand, or attaches it to a sanding tool, such as a sanding block, and moves the abrasive article across the work surface. Sanding by hand can, of course, be an arduous task.

Sheet-like abrasive articles include, for example, conventional sandpaper and resilient sanding sponges. Conventional sandpaper is typically produced by affixing abrasive mineral to a relatively thin, generally non-extensible, non-resilient, non-porous backing (e.g., paper, film etc.). Conventional sanding sponges generally include a resilient backing that is easier and more comfortable to use than conventional sandpaper.

Resilient sheet-like abrasive articles are also known in the patented prior art. U.S. Pat. No. 6,613,113 (Minick et al.), for example, discloses a flexible abrasive product comprising a flexible sheet-like reinforcing layer comprising a multiplicity of separated resilient bodies connected to each other in a generally planar array in a pattern that provides open spaces between adjacent connected bodies, each body having a first surface and an opposite second surface, and abrasive particles to cause at least the first surface to be an abrasive surface. While such resilient abrasive articles generally perform well, it has been found that such abrasive articles, when produced in coarse grades (for example, having a grit size of about 40 to about 80) wear more quickly than such abrasive articles produced in finer grades, particularly when used in certain end use applications such as the sanding of edges or corners.

It would be desirable to provide a resilient abrasive article having a backing layer comprising a multiplicity of separated resilient bodies, such as the backings described in U.S. Pat. No. 6,613,113 (Minick et al.), that is more durable and produces a more uniform scratch pattern, and to also provide a resilient abrasive article that is easier to use, lasts longer, has improved cut, and produces finer scratches than a sheet of sandpaper having a comparable grit size.

SUMMARY

The present invention provides a resilient hand-held abrasive article including a flexible and/or conformable backing layer having opposed first and second major surfaces, a flexible reinforcing layer affixed to at least one of the backing layer first and second major surfaces, and abrasive particles arranged on the reinforcing layer, thereby defining an abrasive surface. The backing layer comprises a multiplicity of separated resilient bodies connected to each other in a generally planar array in a pattern that provides open spaces between adjacent connected bodies, each body having a first surface and an opposite second surface.

The reinforcing layer, among other things, serves to improve the durability of the abrasive article. The improved durability is particularly evident when the abrasive article is provided with coarse grade abrasive particles that would otherwise have a tendency to damage the backing layer. Thus, in one embodiment, the abrasive article includes coarse grade abrasive particles having a grit size of about 40 to about 80. In addition, by providing a flexible reinforcing layer, the separated resilient bodies are allowed to move somewhat independently, thereby producing a finer scratch pattern on the work surface than an abrasive article having an inflexible reinforcing layer.

In various embodiments, the reinforcing layer may be a knitted fabric material a woven cloth material, an open mesh material, or a scrim. In another embodiment, the reinforcing layer may be a continuous film. In a specific embodiment, the invention includes a make coat that affixes the abrasive particles to the reinforcing layer and also affixes the reinforcing layer to the backing layer.

In another embodiment, the backing layer has a thickness of no less than about 1 mm and no greater than about 15 mm. In various embodiments, the backing layer and the reinforcing layer may be adhesively bonded together, or the backing layer and the reinforcing layer may be laminated using flame bonding.

BRIEF DESCRIPTION OF THE DRAWINGS

The present invention will be further described with reference to the accompanying drawings, in which.

DETAILED DESCRIPTION

Figure 1:
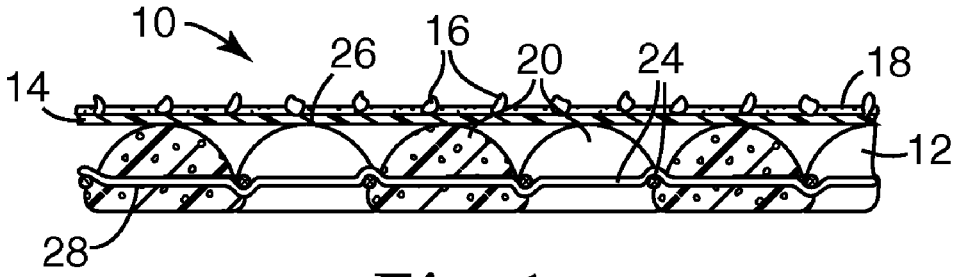
FIG. 1 is a cross-sectional view of a resilient abrasive article according to the invention.
Figure 2:
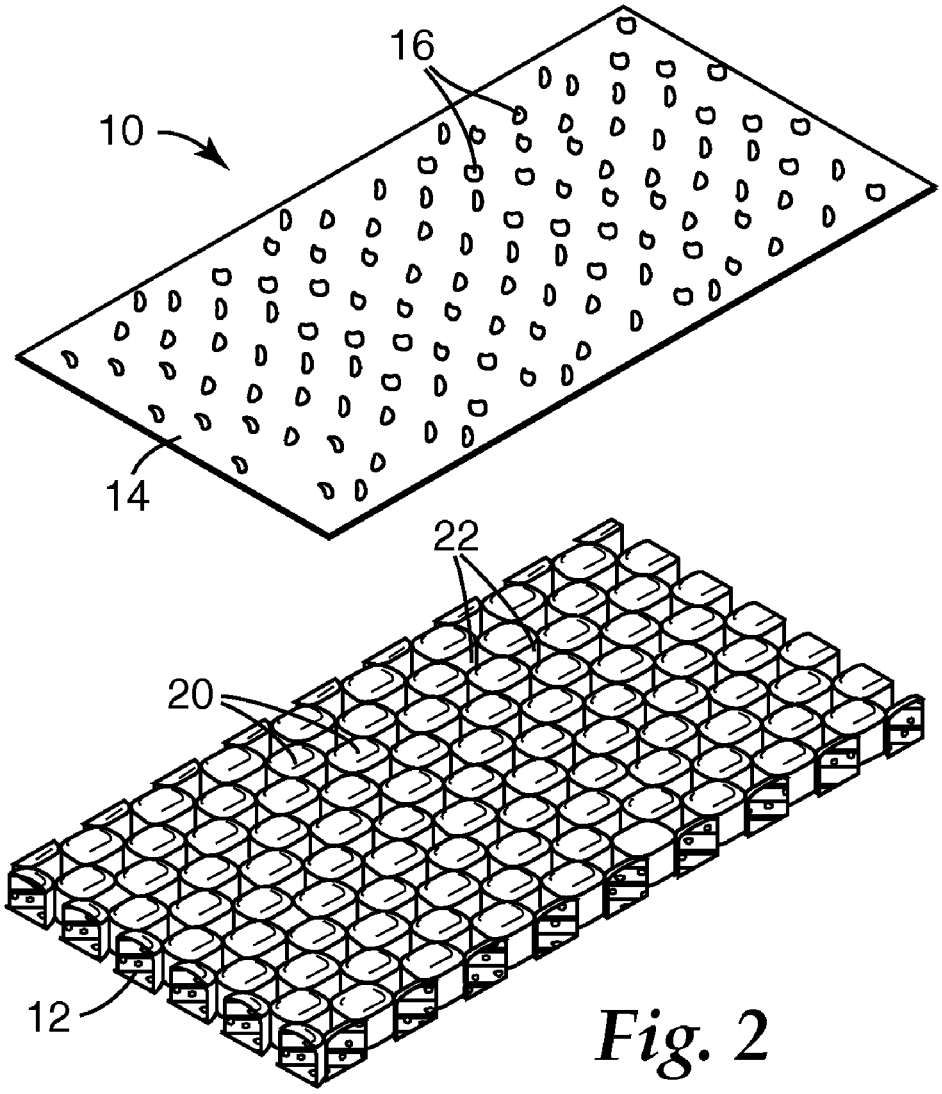
FIG. 2 is an exploded perspective view of the resilient abrasive article of FIG. 1.

Referring now to the drawings, wherein like reference numerals refer to like or corresponding parts throughout the several views, FIGS. 1 and 2 show a resilient abrasive article 10 including a backing layer 12, a reinforcing layer 14 and a plurality of abrasive particles 16 at least partially embedded in a make coat 18. The backing layer 12, reinforcing layer 14, abrasive particles 16 and make coat 18 are each described in detail below.

Backing Layer

The backing layer 12 is formed of a resilient material that provides a comfortable gripping surface for the user, improves the conformability of the abrasive article and, thereby, allows the abrasive article 10 to more effectively sand curved and contoured surfaces.

The backing layer 12 is formed of a plurality of separated resilient bodies 20 that are held together in a pattern so as to provide openings 22 between each adjacent separated body yet connected to one another at contact points. While such backing layers may be formed by appropriate die cutting of a continuous or solid sheet of rubber or a sheet of foam material, the illustrated backing layer 12 includes a scrim 24 including parallel threads and cross-parallel threads typically in a grid pattern that provides openings, every other one of which is closed by a resilient body in an offset pattern.

Each resilient body 20 includes a first surface 26, which may be convex or domed, and a second surface 28, which may be flat. The collection of second surfaces 28 provides an easily handleable backside of the abrasive article 10 that easily conforms to the hand of a user to provide a convenient deformable product that is easily utilized to abrade surfaces having a complex shape.

Suitable materials for the open backing layer 12, such as those described above, are commercially available under the trade names OMNI-GRIP, MAXI-GRIP, ULTRA GRIP, EIRE-GRIP, and LOC-GRIP from Griptex Industries, Inc. of Calhoun, Ga. Such products may be made according to U.S.

Pat. No. 5,707,903 (Schottenfeld), the entire contents of which are hereby incorporated by reference.

Such materials may be formed, for example, by dipping a scrim 24 into a liquid composition that is curable to form a polyvinylchloride (PVC) foam. The scrim may be made of natural or synthetic fibers that may be either knitted or woven in a network having intermittent openings spaced along the surface of the scrim. The scrim need not be woven in a uniform pattern but may also include a nonwoven random pattern. Thus, the openings 22 may either be in a pattern or randomly spaced. The scrim network openings may be rectangular or they may have other shapes including a diamond shape, a triangular shape, an octagonal shape or a combination of these shapes.

Preferably the scrim 24 comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies. The scrim may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The composition of the resilient bodies may either be foamed or non-foamed, and may be composed of any of a variety of elastomeric materials including, but not limited to, polyurethane resins, polyvinyl chloride resins, ethylene vinyl acetate resins, synthetic or natural rubber compositions, acrylate resins and other suitable elastomeric resin compositions.

Such backing layers are characterized by having open areas between resilient bodies to provide cumulative open areas as compared to the total area of the resilient body on the order of about 20% to about 80%, more preferably, between about 30% to about 60%.

The backing layer 12 has a sufficient thickness to make it convenient for being hand-held and to provide a comfortable grip, and/or to allow it to be installed on a sanding tool. The thickness is measured between the highest point of the first surface 26 of a resilient body 20 to the second surface 28 of the resilient body. The thickness preferably is between about 1 mm and about 15 mm, more preferably about 3 mm to about 10 mm.

While a square or rectangular shape of the resilient body 20 is preferred, the bodies 20 may be any convenient geometric shape including, but not limited to, square, rectangular, triangular, circular, oval, and in the shape of a polygon. The resilient bodies 20 are preferably uniform in shape, but they need not be. The resilient bodies 20 may be aligned in rows longitudinally and in a transverse direction.

The dimensions of the resilient bodies 20 may vary from about 2 to about 25 mm, preferably from 5 to 10 mm. Each "dimension" refers to the dimension of a side if rectangular, the diameter if circular, or the maximum dimension if of an irregular shape. The shapes of the resilient bodies 20 need not be a defined shape but could be randomly shaped. When referring to the dimensions of the resilient body, the dimensions are intended to include the widths in the longitudinal or transverse direction or the maximum dimension of the body when measured from one side to the other, notwithstanding any direction.

The openings 22 in the backing layer 12 are generally individually smaller than the adjacent resilient body 20 and may have dimensions on the order of about 2 mm to about 25 mm, preferably of about 5 mm to about 10 mm. The openings 22 may be somewhat rectangular if the resilient bodies 20 are rectangular, or the openings 22 may take any other configuration depending on the shape of the adjacent resilient bodies 20. The shape of the openings 22 is typically defined by the shape of the edges of the resilient bodies 20. The resilient bodies 20 and the openings 22 are generally uniformly distributed throughout the entire area of the flexible abrasive article, but this is not necessary in all cases.

Reinforcing Layer

In accordance with one aspect of the invention, a reinforcing layer 14 is affixed to the first surface 26 of the backing layer 12. The reinforcing layer 14 serves to improve the durability of the abrasive article 10. That is, the reinforcing layer 14 serves to enhance the connection between the abrasive particles 16 and the backing layer 12 so the particles 16 are less likely to separate from the backing layer 12 during use, and further serves to protect the backing layer 12 such that the backing layer 12 is less likely to be damaged by the forces generated by the abrasive particles 16 during use. While not wishing to be bound by theory, it is believed that the reinforcing layer 14 serves to improve the durability of the abrasive article by distributing the forces generated by the abrasive particles 16 during use, thereby reducing the likelihood that those forces will exceed the cohesive strength of the backing layer and therefore damage the backing layer 12. When the abrasive particles 16 are affixed directly to the backing layer 12, the forces generated by the abrasive particles 16 during use are generally concentrated at the attachment point between the abrasive particles and the backing layer, and these forces may damage the backing layer. Because larger particles tend to produce larger forces, damage is more likely to occur when the abrasive article 10 is provided with larger abrasive particles, such as coarse grade abrasive particles having a grit size of about 40 to about 80. Thus, providing the abrasive article 10 with a reinforcing layer 14 has been found to be particularly effective at enhancing the durability of the abrasive article 10 when the abrasive article is provided with coarse grade abrasive particles.

In accordance with a more specific aspect of the invention, the reinforcing layer 14 is typically flexible, thereby to allow each resilient body 20 of the backing layer 12 to move somewhat independently during use. By allowing the resilient bodies 20 to move independently during sanding, the abrasive article produces finer scratches on the work surface than a sheet of sandpaper having a comparable grit size would.

The reinforcing layer 14 is preferably continuous, meaning it does not contain holes, voids, or channels extending therethrough in the Z direction (i.e. the thickness or height dimension) that are larger than any randomly formed spaces that may be produced when the reinforcing layer 14 itself is made. Because the reinforcing layer 14 is continuous, it allows the abrasive article 10 to produce a more uniform scratch pattern.

The reinforcing layer 14 may be formed from a variety of materials. Suitable materials include, for example, knitted or woven fabric materials or cloth, or films such as a thermoplastic film. The particular reinforcing layer material will have sufficient strength for handling during processing, sufficient strength to be used for the intended end use application, the ability to have the make coat 18 transferred to at least one of its major surfaces, and is able to be affixed to the backing layer 12.

The reinforcing layer 14 may be adhesively bonded to the backing layer 12 using, for example, a pressure-sensitive adhesive, a hot melt adhesive, a thermosetting adhesive, by flame bonding, or by other known techniques including lamination. In addition, the reinforcing layer 14 may be saturated with the make coat such that the make coat serves not only to bond the abrasive particles 16 to the reinforcing layer 14, but also serves to bond the reinforcing layer 14 to the backing layer 12.

Make Coat

In general, any make coat 18 may be used to adhere the abrasive particles 16 to the reinforcing layer 14. "Make coat" refers to the layer of hardened resin over the reinforcing layer 14 of the abrasive article 10. A preferred make coat is a phenolic resin. The make coat 18 may be coated onto the reinforcing layer 14 by any conventional technique, such as knife coating, spray coating, roll coating, rotogravure coating, curtain coating, and the like. The abrasive article 10 may also include an optional size coat over the abrasive particles.

Abrasive Particles

In general, any abrasive particles may be used with this invention. Suitable abrasive particles include fused aluminum oxide, heat treated aluminum oxide, alumina-based ceramics, silicon carbide, zirconia, alumina-zirconia, garnet, diamond, ceria, cubic boron nitride, ground glass, quartz, titanium dibromide, sol gel abrasives and combinations thereof. The abrasive particles can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto the make coat by any conventional technique such as electrostatic coating or drop coating.

The abrasive article 10 of the present invention may be provided with abrasive particles 12 of any size. However, because the benefit of the reinforcing layer 14 is particularly apparent when the abrasive article includes coarse grade abrasive particles—that is, because coarse grade abrasive particles are more likely to cause damage to the backing layer 12 if the reinforcing layer is not provided—in accordance with a specific aspect of the invention, the abrasive particles are typically coarse grade abrasive particles having a grit size of about 20 to about 100, and more typically from about 30 to about 90, and even more typically, from about 40 to about 80.

Additives

The make coat precursor or the size coat precursor or both can contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Persons of ordinary skill in the art may appreciate that various changes and modifications may be made to the invention described above without deviating from the inventive concept. For example, it will be recognized that a reinforcing layer coated with abrasive particles may be provided on both sides of the baking layer, thereby forming a double sided abrasive article. Thus, the scope of the present invention should not be limited to the structures described in this application, but only by the structures described by the language of the claims and the equivalents of those structures.

What is claimed is:

1. A resilient hand-held abrasive article, comprising:

(a) a flexible conformable backing layer opposed first and second major surfaces, the backing layer comprising a multiplicity of separated resilient bodies connected to each other in an array that provides open spaces between adjacent connected bodies, each body having a first surface and an opposite second surface; and (b) a flexible reinforcing layer having a first major surface affixed to the first surface of the separated resilient bodies, and a second opposed major surface having abrasive particles arranged thereon, thereby defining an abrasive surface.

2. An abrasive article as defined in claim 1, wherein the reinforcing layer is a knitted fabric material.

3. An abrasive article as defined in claim 1, wherein the reinforcing layer is a woven cloth material.

4. An abrasive article as defined in claim 1, wherein the reinforcing layer is an open mesh material.

5. An abrasive article as defined in claim 1, wherein the reinforcing layer is a scrim.

6. An abrasive article as defined in claim 1, wherein the reinforcing layer is a continuous film.

7. An abrasive article as defined in claim 1, wherein the backing layer has a thickness of no less than about 1 mm and no greater than about 15 mm.

8. An abrasive article as defined in claim 1, wherein the backing layer includes a scrim that provides a structure that supports and connects the separated resilient bodies.

9. An abrasive article as defined in claim 8, wherein the scrim includes a plurality of adjacent openings and wherein resilient bodies are located in alternate openings with adjacent openings being devoid of resilient bodies to provide multiple openings through the abrasive product.

10. An abrasive article as defined in claim 9, wherein the scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies.

11. An abrasive article as defined in claim 10, wherein the scrim comprises an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

12. An abrasive article as defined in claim 1, wherein the backing layer has an open space in the range of about 20% to 80%.

13. An abrasive article as defined in claim 1, wherein each of the resilient bodies has a size and shape that is substantially uniform.

14. An abrasive article as defined in claim 13, wherein the first surface of each resilient body is dome-shaped.

15. An abrasive article as defined in claim 14, wherein the resilient bodies comprise a foam material.

* * * * *

UNITED STATES PATENT AND TRADEMARK OFFICE

CERTIFICATE OF CORRECTION

PATENT NO. : 7,285,146 B2
APPLICATION NO. : 11/275361
DATED : October 23, 2007
INVENTOR(S) : John G. Petersen It is certified that error appears in the above-identified patent and that said Letters Patent is hereby corrected as shown below:

Column 5
Line 27, delete "dibromido," and insert -- diboride, --, therefor.

Column 6
Line 10, in Claim 1, before "layer" insert -- having --.

Signed and Sealed this

First Day of April, 2008

JON W. DUDAS
*Director of the United States Patent and Trademark Office*